US007259506B1

(12) United States Patent
Maxwell

(10) Patent No.: US 7,259,506 B1
(45) Date of Patent: Aug. 21, 2007

(54) SPARK PLUG WITH PERPENDICULAR KNIFE EDGE ELECTRODES

(76) Inventor: Glenn E. Maxwell, 20 Spring St., Carneys Point, NJ (US) 08069

( * ) Notice: Subject to any disclaimer, the term of this patent is extended or adjusted under 35 U.S.C. 154(b) by 77 days.

(21) Appl. No.: 10/977,450

(22) Filed: Oct. 29, 2004

(51) Int. Cl.
*H01T 13/20* (2006.01)

(52) U.S. Cl. ..... 313/141; 313/118; 123/169 EL

(58) Field of Classification Search ..... 313/140–142, 313/143, 118; 123/169 R, 169 EL; 445/7
See application file for complete search history.

(56) References Cited

U.S. PATENT DOCUMENTS

| | | | | |
|---|---|---|---|---|
| 1,192,003 | A | 7/1916 | Schmidt | |
| 1,436,760 | A | 11/1922 | Gleason | |
| 1,490,364 | A | 4/1924 | Curran | |
| 1,526,054 | A | 2/1925 | Curran | |
| 1,607,534 | A | 11/1926 | Hantsch | |
| 1,626,081 | A | 4/1927 | Hadrich | |
| 5,264,754 | A * | 11/1993 | Hanitijo et al. | 313/139 |
| 5,373,214 | A * | 12/1994 | McCready | 313/142 |
| 5,384,074 | A * | 1/1995 | Pedersen | 261/107 |
| 5,598,816 | A * | 2/1997 | Pedersen | 123/169 EL |
| 5,821,676 | A * | 10/1998 | Atchinson et al. | 313/140 |
| 6,166,480 | A * | 12/2000 | Ishida et al. | 313/141 |
| 6,366,007 | B1 * | 4/2002 | Cheng | 313/141 |
| 6,495,948 | B1 | 12/2002 | Garrett | |
| 6,844,662 | B2 * | 1/2005 | Morita et al. | 313/141 |

* cited by examiner

*Primary Examiner*—Karabi Guharay
(74) *Attorney, Agent, or Firm*—Norman E. Lehrer

(57) ABSTRACT

A spark plug has an elongated body of substantially circular cross-section with a center axis. A wedge shaped center electrode extends from one end of the body and a wedge shaped ground electrode is arranged in close proximity to the center electrode. Each of the electrodes includes an elongated knife edge. The knife edges extend radially with respect to the center axis but lie in different parallel planes that are perpendicular to the axis. The two knife edges of the electrodes are spaced apart from each other and extend perpendicular to each other.

6 Claims, 1 Drawing Sheet

SPARK PLUG WITH PERPENDICULAR KNIFE EDGE ELECTRODES

BACKGROUND OF THE INVENTION

The present invention is directed toward a spark plug for use in an internal combustion engine and more particularly, toward an improved spark plug that utilizes a novel arrangement of wedge shaped electrodes and that has a longer life and creates a more consistent spark.

A typical spark plug includes a center electrode and a ground electrode. The two electrodes are spaced apart from each other. When electricity passes across the space between the two electrodes, a spark is created. This spark may be used to ignite a fuel mixture contained within the internal combustion engine to which the spark plug is attached.

While the shapes of the center electrode and ground electrode may vary, typically, the tips of each of these electrodes are axially aligned along the axis of the main body of the spark plug. Different electrode shapes and configurations are shown, for example, in U.S. Pat. No. 6,495,948 to Garrett, III.

Spark plugs have been proposed in the past that utilize a wedge or knife shaped electrode for either or both the center electrode or the ground electrode. U.S. Pat. Nos. 1,490,364 and 1,526,054 to Curran, for example, disclose wedge-shaped electrodes that are axially aligned and parallel to each other and to the axis of the plug body but radially offset therefrom. U.S. Pat. No. 1,192,003 to Schmidt discloses two wedge-shaped electrodes parallel to each other at an angle to the axis of the spark plug and U.S. Pat. No. 1,607,534 to Hantsch discloses two wedged shaped electrodes arranged parallel to each other and which cross the axis of the spark plug body but with each electrode extending radially to the axis of the plug.

Although it is believed that these spark plugs with wedge shaped electrodes are better than standard spark plug designs, it is not believed that they are optimal. None of these patented spark plugs nor other known spark plugs appears to create a consistent spark that moves in the proper manner so as to provide a spark plug with a longer life while providing better performance and increased fuel mileage.

SUMMARY OF THE INVENTION

The present invention is designed to overcome the deficiencies of the prior art discussed above. It is an object of the present invention to provide an improved spark plug that creates a more consistent spark.

It is another object of the present invention to provide an improved spark plug that has a longer life.

It is further object of the present invention to provide an improved spark plug that produces more fire power with minimal quenching and shadowing while providing better engine performance and increased fuel mileage.

In accordance with the illustrative embodiments demonstrating features and advantages of the present invention, there is provided an improved spark plug that includes an elongated spark plug body of substantially circular cross-section with a center axis. A wedge shaped center electrode extending axially from one end of the spark plug body and a wedge shaped ground electrode arranged in close proximity to said center electrode. Each of said electrodes has a radially extending elongated narrow or knife edge that preferably lies in a different plane perpendicular to the axis of the spark plug. The elongated knife edges of the two electrodes, however, are arranged perpendicular to each other.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown

DETAILED DESCRIPTION OF THE PREFERRED EMBODIMENT

Figure 1:
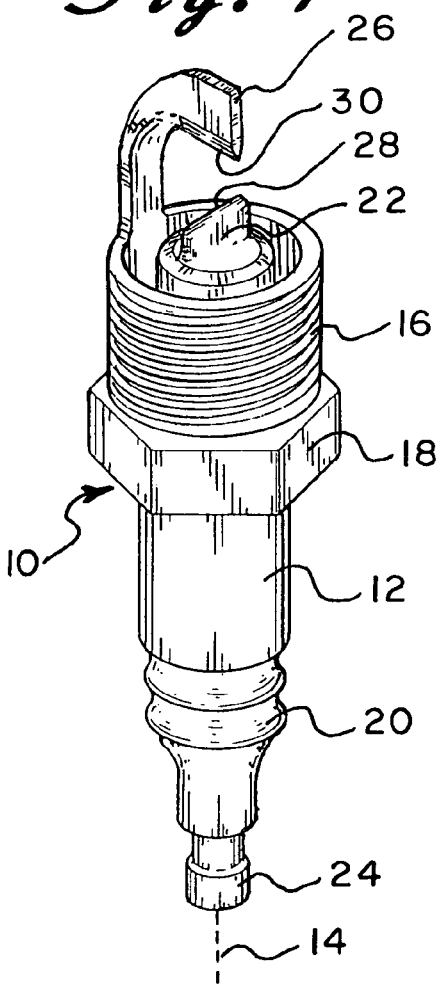
FIG. 1 is a perspective of a preferred embodiment of a spark plug according to the present invention.

Referring now to the drawings in detail wherein like reference numerals have been used throughout the various figures to designate like elements, there is shown in FIG. 1 a spark plug constructed in accordance with the principles of the present invention and designated generally as 10.

The major components and construction of the spark plug 10 of the present invention are essentially conventional. Accordingly, the details thereof and the manner in which the spark plug generally operates will not be described. Suffice it to say that the spark plug 10 includes an elongated body 12 of substantially circular cross section with a center axis shown diagrammatically at 14.

The spark plug 10 includes a threaded shell 16 which permits the spark plug to be screwed into an engine block or the like utilizing the nut 18. An insulator 20 passes through the center of the body 12. A center electrode 22 passes through the insulator 20 and terminates at its lower end in an electrical terminal 24. A ground electrode 26 is arranged in close proximity to the center electrode 22.

The spark plug thus far described is generally of conventional construction as pointed out above. As will be readily apparent to those skilled in the art, there will, of course, be variations in the appearance, size and shape of the spark plug. The arrangement thus described, however, is essentially conventional. The present invention relates primarily to the shape and arrangement of the electrodes 22 and 26.

Figure 4:
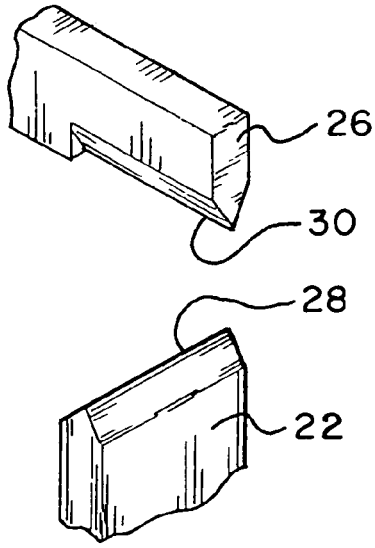
FIG. 4 is an exploded and enlarged view of the electrodes illustrating the shapes and arrangement thereof.
Figure 3:
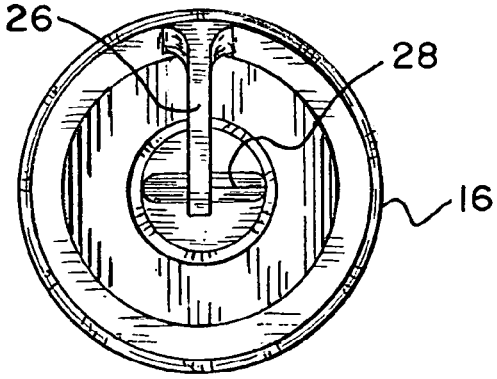
FIG. 3 is a top plan view of the spark plug of FIG. 1.

As perhaps best illustrated in FIG. 4, each of the electrodes 22 and 26 is formed to be essentially wedge shaped with a knife edge 28 and 30, respectively. The knife edges 28 and 30 of the electrodes 22 and 26 are elongated, are spaced from each other by a desired distance and are arranged so as to be perpendicular to each other as best shown in FIGS. 1 and 3.

Figure 2:
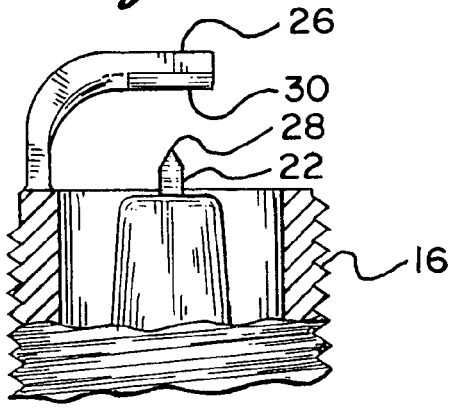
FIG. 2 is a side elevational view of the tip of the spark plug of FIG. 1 showing the details of the electrodes.

As is also shown in FIGS. 1 and 2, the central electrode 22 with the knife edge 28 extends from the main body portion 12 of the spark plug 10 and is essentially in axial alignment with the axis 14. The knife edge 28, however, forms a line which extends in a radial direction relative to the axis 14. The line that forms the knife edge 28 is preferably in a plane that is perpendicular to the axis 14 of the spark plug body 12.

The knife edge 30 of the ground electrode 26 lies just above the knife edge 28 of the center electrode 22 and faces the same. As shown in FIG. 2, the knife edge 30 of the ground electrode 26 also forms a line which extends radially with respect to the axis 14 of the plug body 12. Preferably, the line formed by the knife edge 30 lies in a plane which is also perpendicular to the axis 14 of the plug body 12 and is parallel to the plane mentioned above in which the knife edge 28 of the center electrode lies.

The manner in which the various electrodes are formed can, of course, be changed as desired. For example, while the electrode 26 is shown as being essentially a continuation of the metal that forms the threads 16 which extends upwardly and then inwardly toward the axis of the plug with the bottom thereof formed into the knife edge 30, it is also possible to form said electrode by having a similar rectangular extension of metal bent 90° onto its side as it extends forwardly so as to form the electrode and knife edge. Other arrangements are also possible as long as the two edges 28 and 30 of the electrodes are arranged perpendicular to each other as shown in FIG. 4.

It has been observed that with the unique design of the spark plug and electrodes described above, provides for a variable spark gap that allows the spark to move in a rhythmic pattern resulting in vertices producing more fire power, with minimal quenching and shadowing thereby providing better performance and increased fuel mileage.

The present invention may be embodied in other specific forms without departing from the spirit or essential attributes thereof and accordingly, reference should be made to the appended claims rather than to the foregoing specification as indicating the scope of the claims.

I claim:

1. In a spark plug having an elongated body of substantially circular cross-section with a center axis, a single wedge shaped center electrode extending from one end of said body and a single wedge shaped ground electrode arranged in close proximity to said center electrode, each of said electrodes including a single continuous elongated knife edge, wherein the improvement comprising said knife edges of said center electrode and of said ground electrode being arranged so as to be nonparallel to each other, the knife edges of each said wedge shaped electrodes being spaced apart from but face each other and wherein each of said knife edges lies in a different plane perpendicular to said axis of the spark plug.

2. The improvement of claim 1 wherein said wedge shaped center electrode extends axially from said one end of said body.

3. The improvement of claim 2 wherein said wedge shaped center electrode is intersected by said axis of said body.

4. In a spark plug having an elongated body of substantially circular cross-section with a center axis, a single wedge shaped center electrode extending from one end of said body and a single wedge shaped ground electrode arranged in close proximity to said center electrode, each of said electrodes including a single continuous elongated knife edge, wherein the improvement comprising said knife edges of said center electrode and of said ground electrode being perpendicular to each other, the knife edges of each said wedge shaped electrodes being spaced apart from but face each other and wherein each of said knife edges lies in a different plane perpendicular to said axis of the spark plug.

5. The improvement of claim 4 wherein said wedge shaped center electrode extends axially from said one end of said body.

6. The improvement of claim 5 wherein said wedge shaped center electrode is intersected by said axis of said body.

* * * * *